US008186079B2

(12) United States Patent
Carboy et al.

(10) Patent No.: US 8,186,079 B2
(45) Date of Patent: May 29, 2012

(54) ARTICLE OF FOOTWEAR WITH SIPES

(75) Inventors: Shawn G. Carboy, Portland, OR (US); Anthony Hope, Portland, OR (US); Kelly B. Jarvis, Portland, OR (US); Sarah E. Sowers, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 315 days.

(21) Appl. No.: 12/620,947

(22) Filed: Nov. 18, 2009

(65) Prior Publication Data

US 2010/0281714 A1 Nov. 11, 2010

Related U.S. Application Data

(63) Continuation of application No. 12/436,448, filed on May 6, 2009, now abandoned.

(51) Int. Cl.
*A43B 23/28* (2006.01)

(52) U.S. Cl. ..... 36/59 C; 36/102; D2/951; D2/955

(58) Field of Classification Search ..... 36/25 R, 36/102, 31, 59 C; D2/951–960
See application file for complete search history.

(56) References Cited

U.S. PATENT DOCUMENTS 2,383,117 A * 8/1945 Fellman ..... 36/59 C
4,498,251 A 2/1985 Shin
4,658,514 A 4/1987 Shin
D391,748 S * 3/1998 Koh ..... D2/951
D395,343 S * 6/1998 Lozano ..... D2/960
D401,395 S * 11/1998 Clarke ..... D2/953
D407,892 S * 4/1999 Gaudio ..... D2/960
6,065,230 A * 5/2000 James ..... 36/25 R
6,076,283 A * 6/2000 Boie ..... 36/59 C
D433,790 S * 11/2000 Oliver ..... D2/957
D461,298 S * 8/2002 Urie et al. ..... D2/955
D495,858 S * 9/2004 McClaskie ..... D2/960
D496,779 S * 10/2004 Belley et al. ..... D2/960
D507,096 S * 7/2005 Chen ..... D2/953
D512,818 S * 12/2005 Mitani et al. ..... D2/953
6,990,755 B2 1/2006 Hatfield et al.
7,171,767 B2 2/2007 Hatfield et al.
D552,333 S * 10/2007 McClaskie ..... D2/953
7,287,342 B2 10/2007 Keen
7,290,357 B2 11/2007 McDonald et al.
D560,335 S * 1/2008 Turner et al. ..... D2/959
7,320,189 B2 1/2008 Clark et al.
D563,087 S * 3/2008 Nakano ..... D2/957
7,347,012 B2 3/2008 Clark et al.
D571,988 S * 7/2008 Dillenbeck ..... D2/960
7,392,605 B2 7/2008 Hatfield et al.
D605,385 S * 12/2009 Andersen et al. ..... D2/960
2006/0061012 A1 3/2006 Hatfield et al.
2006/0107552 A1 5/2006 Clark et al.
2006/0107553 A1 5/2006 Clark et al.
2007/0011914 A1 1/2007 Keen et al.
2007/0169376 A1 7/2007 Hatfield et al.
2007/0169379 A1 7/2007 Hazenberg et al.
2008/0022553 A1 1/2008 McDonald et al.
2008/0047165 A1 2/2008 Keen
2008/0216355 A1 9/2008 Becker et al.
2010/0313447 A1 * 12/2010 Becker et al. ..... 36/102

* cited by examiner

*Primary Examiner* — Marie Patterson
(74) *Attorney, Agent, or Firm* — Plumsea Law Group, LLC

(57) ABSTRACT

A sole structure for an article of footwear is disclosed. The sole structure includes an outsole and a midsole. The outsole includes a tread pattern with a nonlinear configuration. A plurality of sipes are provided on the outsole and the midsole. The plurality of sipes have a nonlinear configuration that is substantially similar to the nonlinear configuration of the tread pattern.

23 Claims, 7 Drawing Sheets

ARTICLE OF FOOTWEAR WITH SIPES

CROSS REFERENCE TO RELATED APPLICATION

This application is a Continuation of currently U.S. application Ser. No. 12/436,448 now abandoned, entitled "Article of Footwear with Sipes", filed on May 6, 2009, which is incorporated herein by reference in its entirety.

BACKGROUND

The present invention relates generally to an article of footwear, and in particular to an article of footwear with sipes.

Becker et al. (U.S. patent application publication number 2008/0216355) teaches an article of footwear with an outer member that includes slots which increase the flexibility of the footwear. Specifically, Becker et al. teaches a shoe having an upper, an outer member and an inner plate. The outer member includes a set of horizontal slots which facilitate bending in the shoe. These slots generally are disposed on and extend through a central portion of the outer member. The outer member may be associated with a treaded surface that may include a tread pattern. The treaded surface may also include horizontal slots that facilitate bending.

McDonald et al. (U.S. Patent Application Publication Number 2008/0022553) teaches an article of footwear that includes an insole, an outsole, and a midsole having a connecting portion and a siped portion. A plurality of sole elements are formed on sipe portion by sipes which extend upwards into the midsole and between the sole elements. McDonald teaches that the sipes affect the direction of flex in the midsole.

SUMMARY

In one aspect, the invention provides an article of footwear, comprising: a sole structure including a midsole and an outsole; the outsole including a tread pattern, the tread pattern having a first nonlinear configuration; a sipe disposed on the sole structure, the sipe having a second nonlinear configuration; and where the second nonlinear configuration of the sipe corresponds to the first nonlinear configuration of the tread pattern.

In one aspect the invention provides an article of footwear, comprising: a sole structure including a midsole and an outsole; the outsole including a tread pattern comprising a tread element, the tread element having a nonlinear configuration; a sipe disposed adjacent to the tread element; the tread element comprising a first tread segment oriented in a first direction and a second tread segment oriented in a second direction that is different from the first direction; and where the sipe has a first sipe segment that is oriented in the first direction and wherein the sipe has a second sipe segment that is oriented in the second direction.

In one aspect, the invention provides an article of footwear, comprising: a sole structure including a midsole and an outsole; the outsole including a first tread pattern associated with a first portion of the outsole, the first tread pattern having a first nonlinear configuration; the outsole including a second tread pattern associated with a second portion of the outsole, the second tread pattern having a second nonlinear configuration that is different than the first nonlinear configuration; a first sipe disposed in the first portion of the outsole and a second sipe disposed in the second portion of the outsole; and where the first sipe has the first nonlinear configuration and wherein the second sipe has the second nonlinear configuration.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
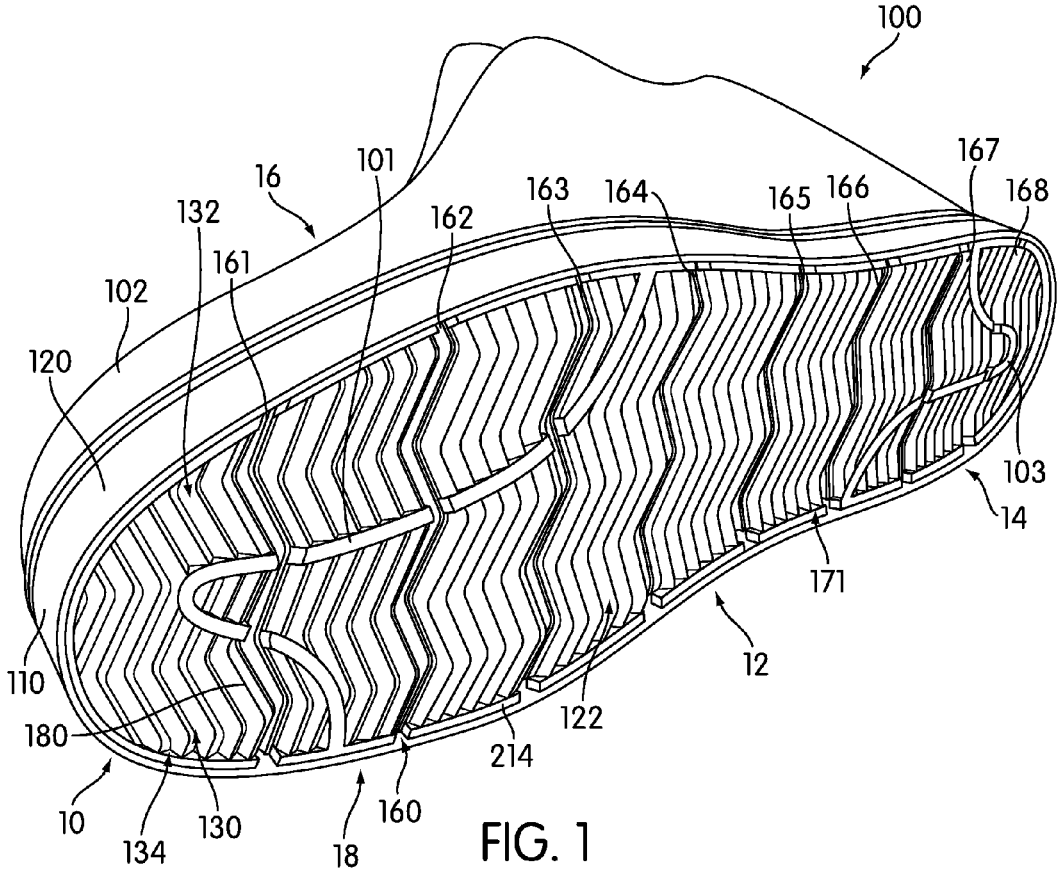
FIG. 1 is an isometric view of an embodiment of a sole structure.

FIGS. 1 through 5 illustrate an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 through 5, article of footwear 100, also referred to simply as article 100, is intended to be used with a left foot; however, it should be understood that the following discussion may equally apply to a mirror image of article of footwear 100 that is intended for use with a right foot.

Referring to FIGS. 1 through 5, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

Article 100 can include an upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 can include midsole 120 and outsole 122.

Figure 2:
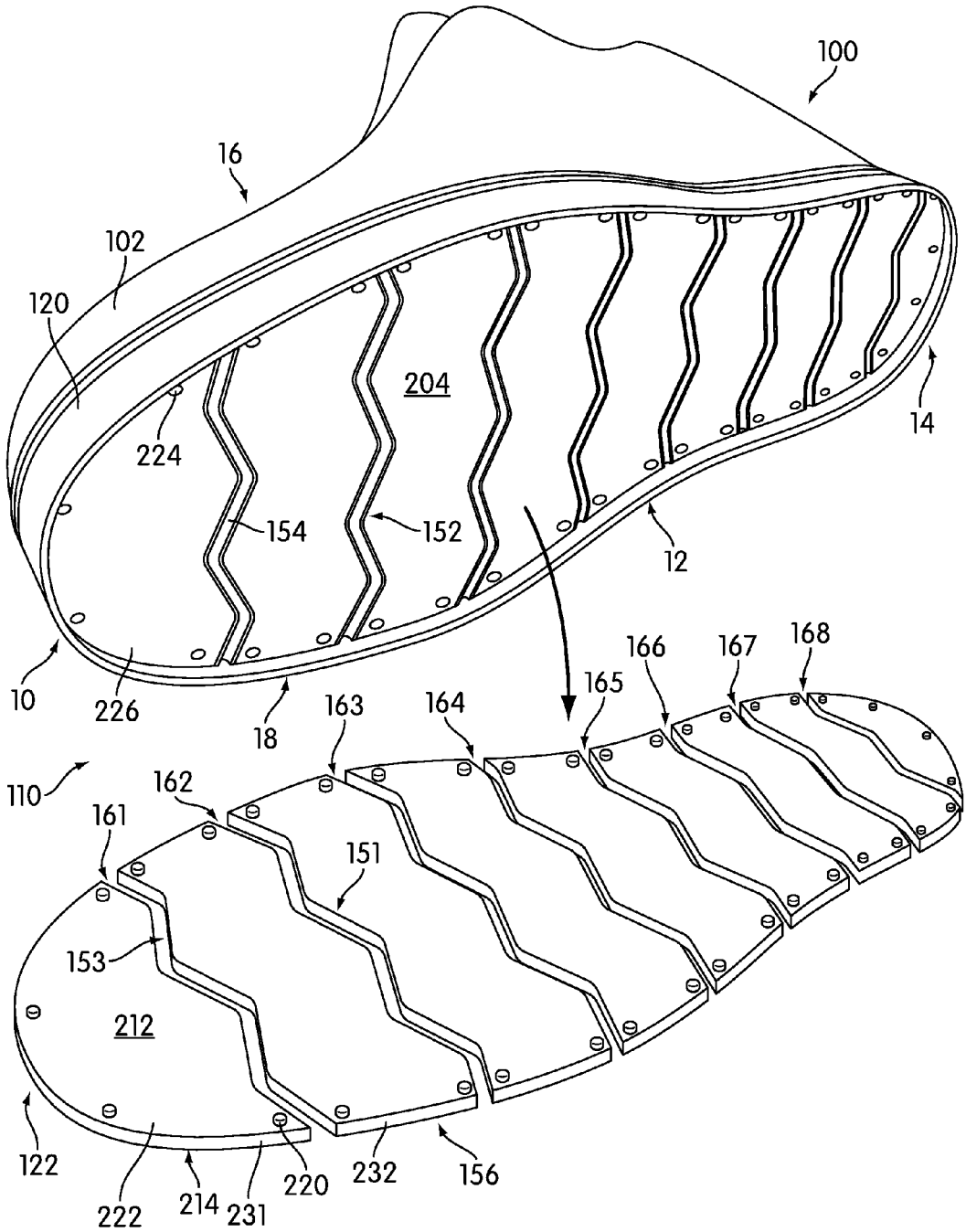
FIG. 2 is an exploded isometric view of an embodiment of a sole structure.

In one embodiment, midsole 120 can include upper surface 202 (see FIG. 4) and lower surface 204 (see FIG. 2). Upper surface 202 of midsole 120 may be configured to receive upper 102. In addition, outsole 122 can include inner surface 212 and outer surface 214. Inner surface 212 of outsole 122 may be configured to confront lower surface 204 of midsole 120, while outer surface 214 of outsole 122 may be configured to contact a ground surface.

In some embodiments, sole structure 110 can include provisions for assembling midsole 120 and outsole 122 together. For example, in one embodiment, inner surface 212 of outsole 122 can be provided with protrusions 220 disposed on peripheral region 222 of outsole 122. In addition, lower surface 204 of midsole 120 can include recesses 224 on peripheral region 226 of midsole 120. With this arrangement, recesses 224 can receive protrusions 220 to help join midsole 120 and outsole 122 together. In some cases, protrusions 220 and recesses 224 can provide a frictional fit that helps join outsole 122 to midsole 120. In other cases, protrusions 220 and recesses 224 can provide locating features that assist in aligning outsole 122 with midsole 120. In particular, in embodiments where outsole 122 may comprise a set of individual outsole portions that are joined to midsole 120 separately, this arrangement can help provide more accurate alignment for the individual outsole portions.

Sole structure 110 can include one or more tread patterns that are disposed on outsole 122. The term "tread pattern" as used throughout this detailed description and in the claims refers to any arrangement of tread elements into a predetermined pattern. In some cases, tread patterns can be applied to an outsole to enhance traction for an article of footwear. In other cases, tread patterns can be applied to an outsole to enhance the aesthetic appearance of the outsole.

In one embodiment, outer surface 214 of outsole 122 can be associated with tread pattern 130. In particular, tread pattern 130 can comprise plurality of tread elements 132. In addition, plurality of tread elements 132 can be separated by tread grooves 134 that are disposed between adjacent tread elements. In an exemplary embodiment, plurality of tread elements 132 may be integrally formed with outsole 122. However, in other embodiments, plurality of tread elements 132 may be distinct elements that are attached to outer surface 214 of outsole 122.

In different embodiments, tread pattern 130 can be disposed on various portions of outsole 122. In some cases, tread pattern 130 can be disposed on forefoot portion 10 of outsole 122. In other cases, tread pattern 130 can be disposed on midfoot portion 12 of outsole 122. In still other cases, tread pattern 130 can be disposed on heel portion 14 of outsole 122. In an exemplary embodiment, tread pattern 130 can extend through forefoot portion 10, midfoot portion 12 and heel portion 14. With this arrangement, tread pattern 130 can provide enhanced traction to a majority of outsole 122.

In some embodiments, plurality of tread elements 132 can comprise ridge-like tread elements that generally extend from lateral side 16 to medial side 18 of outsole 122. In particular, each tread element of plurality of tread elements 132 can have a length that is substantially greater than a width of the tread element. In addition, each tread element of plurality of tread elements 132 can have a height that is substantially less than a length of the tread element. In other embodiments, however, the length, width and height of each tread element can vary.

In different embodiments, the spacing between adjacent tread elements comprising plurality of tread elements 132 can vary. In some embodiments, the spacing between adjacent tread elements can be substantially constant throughout tread pattern 130. In other embodiments, the spacing between adjacent tread elements can vary throughout tread pattern 130. In an exemplary embodiment, the spacing between adjacent tread elements may be substantially similar throughout tread pattern 130.

Figure 4:
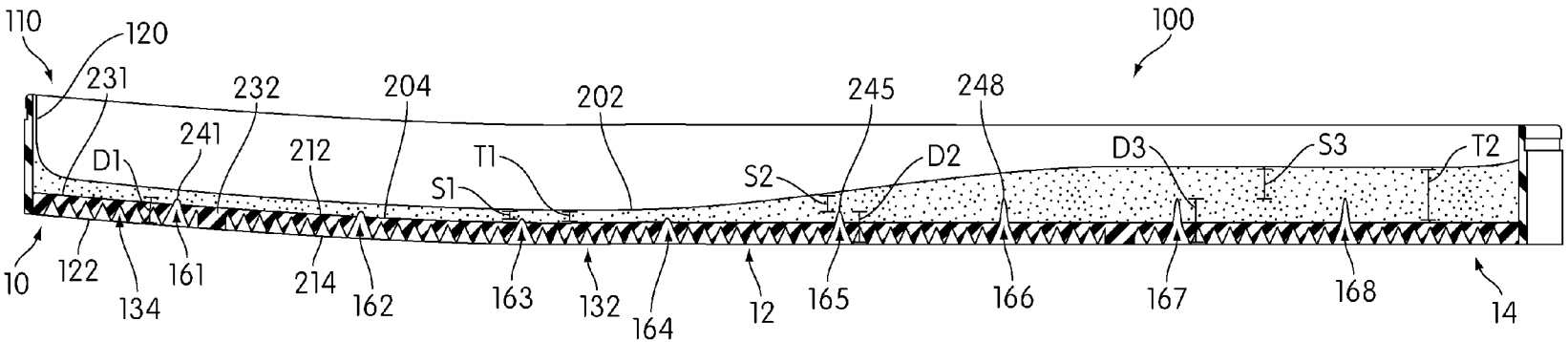
FIG. 4 is a side cross-sectional view of an embodiment of a sole structure.
Figure 5:
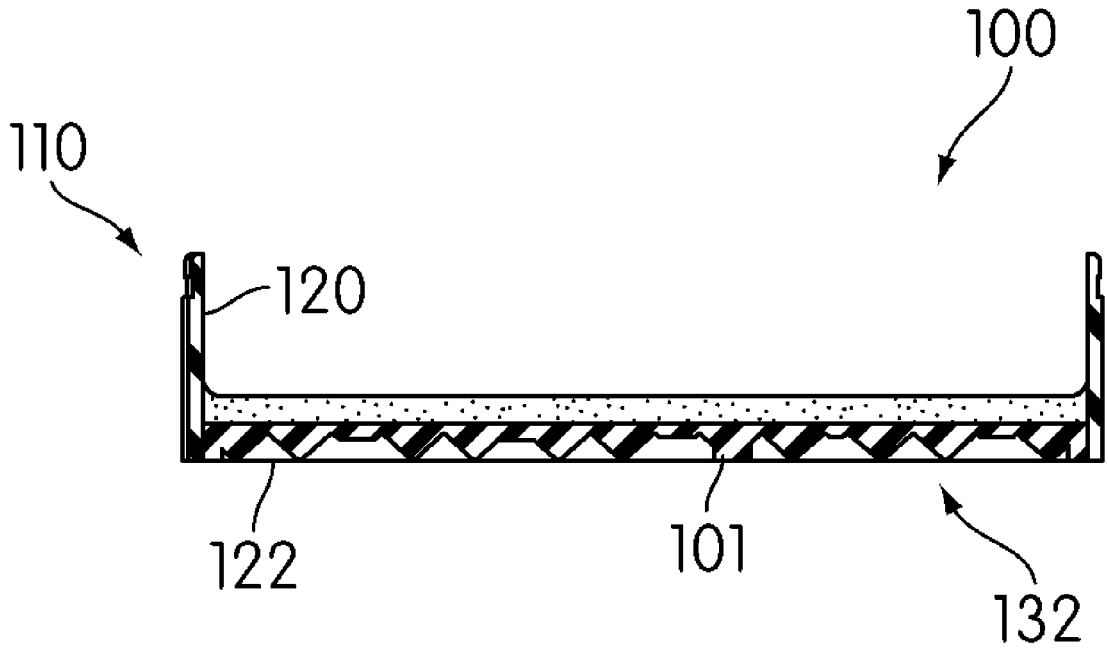
FIG. 5 is a cross-sectional view of an embodiment of a sole structure.

In different embodiments, the cross-sectional shape of one or more tread elements of plurality of tread elements 132 can vary. In some embodiments, each tread element of plurality of tread elements 132 can be associated with a substantially triangular cross-sectional shape, as illustrated in FIG. 4. In other embodiments, however, each tread element of plurality of tread elements 132 can have other types of cross-sectional shapes, including, but not limited to: rounded, rectangular, polygonal, regular and irregular cross sectional shapes, as well as any other types of cross-sectional shapes.

Generally, a tread pattern can include tread elements arranged in various configurations. In some embodiments, tread elements of a tread pattern can be arranged in substantially linear configurations. For example, in some cases, tread elements in a tread pattern can be arranged as linear tread elements that are oriented in a substantially lateral direction. In other cases, tread elements in a tread pattern can be arranged as linear ridges that are oriented in a substantially longitudinal direction or a diagonal direction. In other embodiments, however, tread elements of a tread pattern can have be arranged in substantially nonlinear configurations. For example, in some cases, tread elements can have a generally wavy shape that extends between the lateral and medial sides of an outsole. In other cases, tread elements can be arranged in any other nonlinear configuration.

It will be understood that the term "nonlinear configuration" is not intended to be limited to a particular type of nonlinear shape or arrangement. For example, a nonlinear configuration for a tread pattern can include smooth nonlinear shapes such as sinusoidal shapes, wavy shapes, as well as other smooth nonlinear shapes. Also, a nonlinear configuration for a tread pattern can include polygonal nonlinear shapes with edges such as zig-zag shapes, triangle wave shapes, square wave shapes, as well as any other types of non-smooth nonlinear shapes. Furthermore, in some cases, a tread pattern can be associated with a regular nonlinear configuration that includes repeating patterns. In other cases, however, a tread pattern can be associated with an irregular nonlinear configuration that does not include repeating patterns. In still other cases, a tread pattern can be associated with a nonlinear configuration that includes some portions with repeating patterns and other portions with non-repeating patterns. Still further, some tread patterns can include nonlinear configurations that are symmetric about an axis of an outsole. For example, in embodiments including tread patterns with configurations that are sinusoidal configurations, the tread configurations may be substantially symmetric about a central longitudinal axis of the outsole. In contrast, in other embodiments including tread patterns with configurations that are irregular wave configurations, the tread configurations may not be symmetric about any axis of the outsole.

In one embodiment, tread pattern 130 can have a nonlinear configuration. In other words, plurality of tread elements 132 comprising tread pattern 130 may have nonlinear configurations. For example, first tread element 171 of plurality of tread elements 132 may have a triangular wave configuration. In particular, first tread element 171 may be comprised of alternating tread segments 180 that are arranged in a wave-like manner.

Alternating tread segments 180 may comprise first tread segment 181, second tread segment 182, third tread segment 183 and fourth tread segment 184. In this case, first tread segment 181 is oriented in a different direction than second tread segment 182. Likewise, second tread segment 182 is oriented in a different direction than third tread segment 183. Furthermore, third tread segment 183 is oriented in a different direction than fourth tread segment 184. In other words, first tread segment 181, second tread segment 182, third tread segment 183 and fourth tread segment 184 are arranged in a substantially nonlinear configuration.

In different embodiments, the angles between adjacent tread segments can vary. For example, in this embodiment, first tread segment 181 may form an angle with second tread segment 182 that is substantially less than 180 degrees and substantially greater than 0 degrees. In one embodiment, first tread segment 181 may form an angle approximately in the range between 100 degrees and 160 degrees with second tread segment 182. In a similar manner, in some embodiments, adjacent segments of alternating tread segments 180 may also be joined at angles in the range between 100 degrees and 160 degrees.

In a similar manner to first tread element 171, each tread element of plurality of tread elements 132 may have similar nonlinear configurations to first tread element 171. In other words, each tread element of plurality of tread elements 132 may have similar triangular wave configurations. With this arrangement, each tread element of plurality of tread elements may be aligned with one another in a manner that creates a herringbone pattern for tread pattern 130.

In some embodiments, outsole 122 may comprise first raised tread element 101 and second raised tread element 103. First raised tread element 101 may be configured as a curve that extends through forefoot portion 10 and into midfoot portion 12. Also, second raised tread element 103 may be configured as a curve that extends through heel portion 14. In some cases, first raised tread element 101 and second raised tread element 103 may provide additional traction for outsole 122. In other cases, first raised tread element 101 and second raised tread element 103 may provide additional aesthetic appeal for outsole 122.

An article of footwear can include provisions for enhancing the flexibility of a sole structure. In some cases, the materials used for making a sole structure may be substantially flexible. In other cases, a sole structure can be provided with structural features that facilitate flexibility. In an exemplary embodiment, a sole structure can be provided with one or more sipes that provide flexibility in one or more directions.

In one embodiment, sole structure 110 can include plurality of sipes 160. In particular, sole structure 110 can include first sipe 161, second sipe 162, third sipe 163, fourth sipe 164, fifth sipe 165, sixth sipe 166, seventh sipe 167 and eighth sipe 168. Although the current embodiment includes eight sipes, in other embodiments a different number of sipes may be associated with sole structure 110. In some cases, only a single sipe may be used with sole structure 110. In other cases, any number of sipes between two and eight may be used. In still other cases, more than eight sipes can be used with sole structure 110.

Generally, a sole structure can include sipes arranged in various configurations. In some embodiments, sipes can be arranged in substantially linear configurations. For example, in some cases, sipes can be arranged as linear sipes that are oriented in a substantially lateral direction. In other cases, sipes can be arranged as linear sipes that are oriented in a substantially longitudinal direction or a diagonal direction. In other embodiments, sipes can be arranged in substantially nonlinear configurations.

In embodiments where a sole structure includes tread patterns, a sole structure can include provisions for combining the sipes with the tread patterns in a manner that maintains enhanced traction for the article. For example, in embodiments where tread elements have nonlinear configurations, one or more sipes can also be configured with substantially similar nonlinear configurations. This arrangement can help preserve the nonlinear configuration of the tread pattern by using similar nonlinear configurations for the sipes instead of linear sipes that could interrupt the nonlinear tread pattern and decrease traction.

In one embodiment, plurality of sipes 160 can have nonlinear configurations. For example, in this embodiment, sixth sipe 166 may have a nonlinear configuration. In particular, sixth sipe 166 may have a triangular wave configuration that is substantially similar to the configuration of first tread element 171. In some cases, sixth sipe 166 may comprise alternating sipe segments 190 that are arranged in a similar configuration to alternating tread segments 180. In this case, alternating sipe segments 190 may comprise first sipe segment 191, second sipe segment 192, third sipe segment 193 and fourth sipe segment 194. Furthermore, first sipe segment 191, second sipe segment 192, third sipe segment 193 and fourth sipe segment 194 may have a similar configuration to first tread segment 181, second tread segment 182, third tread segment 183 and fourth tread segment 184. In some cases, the angle formed at first sipe segment 191 and second sipe segment 192 may be substantially similar to the angle formed at first tread segment 181 and second tread segment 182. Likewise, other adjacent segments of alternating sipe segments 190 may form approximately similar angles to the angle formed between first sipe segment 191 and second sipe segment 192.

Sipe segments 190 of sixth sipe 166 may be generally aligned with tread segments 180 of first tread 171. In particular, first sipe segment 191 and first tread segment 181 may both be oriented along a first direction, while second sipe segment 192 and second tread segment 182 may be oriented along a second direction that is different from the first direction. Similarly, other adjacent segments of tread segments 180 and sipe segments 190 may be oriented in approximately similar directions. With this arrangement, sixth sipe 166 may have substantially the same nonlinear configuration as first tread element 171.

In a similar manner to sixth sipe 166, each sipe of plurality of sipes 160 may be configured with a substantially similar nonlinear configuration in the current embodiment. In particular, each sipe of plurality of sipes 160 may have a nonlinear configuration that is substantially similar to the nonlinear configuration of tread pattern 130. In the current embodiment, for example, first sipe 161, second sipe 162, third sipe 163, fourth sipe 164, fifth sipe 165, seventh sipe 167 and eighth sipe 168 may all also have substantially triangular wave configurations that are similar to the configuration of sixth sipe 166.

Although the current embodiment discusses tread segments and sipe segments that are approximately linear segments, in other embodiments a tread element and/or a sipe may be divided into curved segments as well as linear segments. In other words, the term "segment" as used throughout this detailed description and in the claims is not intended to be limited to linear segments. Furthermore, it will be understood that any nonlinear configuration for a tread element and/or a sipe may be approximated by a finite number of linear segments.

Figure 3:
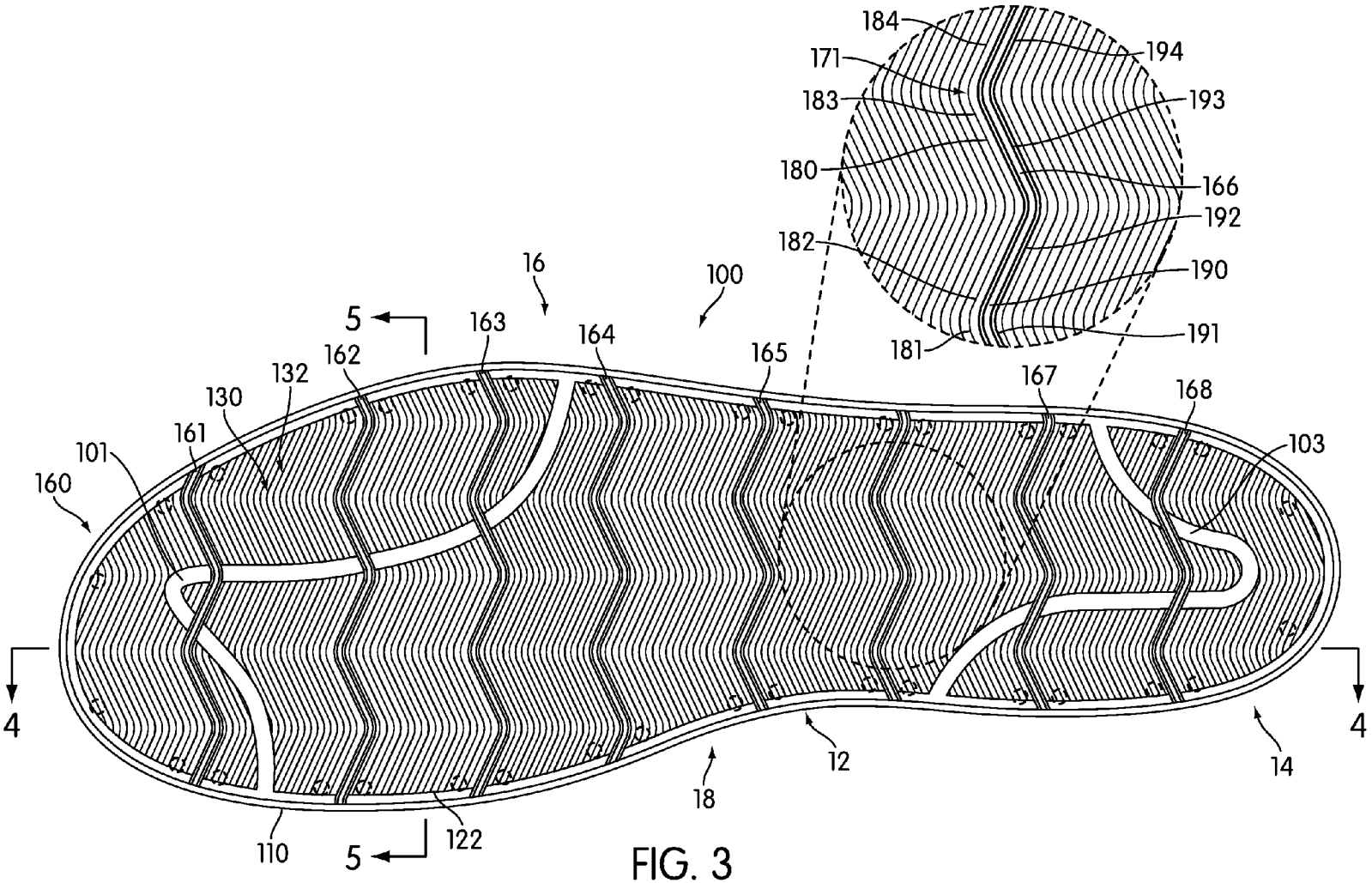
FIG. 3 is a plan view of an embodiment of a sole structure.

Referring now to FIGS. 2 through 4, in different embodiments, each sipe of plurality of sipes 160 can extend through various components of sole structure 110. In some embodiments, sipes of plurality of sipes 160 may only extend through outsole 122. In other words, sipes of plurality of sipes 160 may have depths that are less than a thickness of outsole 122. In other embodiments, sipes of plurality of sipes 160 may extend through both outsole 122 and midsole 120. In other words, sipes of plurality of sipes 160 may have depths that are greater than the thickness of outsole 122. In an exemplary embodiment, sipes of plurality of sipes 160 extend through both outsole 122 and midsole 120.

In one embodiment, plurality of sipes 160 may include plurality of outsole sipe portions 151 that are associated with outsole 122 and plurality of midsole sipe portions 152 that are associated with midsole 120. For example, first sipe 161 may include first outsole sipe portion 153 that is associated with outsole 122 and first midsole sipe portion 154 that is associated with midsole 120. In a similar manner, each sipe of plurality of tread elements 132 includes an outsole sipe portion that extends through outsole 122. Likewise, each sipe of plurality of tread elements 132 includes a midsole sipe portion that extends through midsole 120.

In some cases, plurality of outsole sipe portions 151 may extend through outsole 122 in a manner that divides outsole 122 into plurality of outsole portions 156. For example, in the current embodiment, first outsole sipe portion 153 of first sipe 161 may divide outsole 122 into first outsole portion 231 and second outsole portion 232. This arrangement may help provide increased stability for outsole 122, since outsole portions 232 may be configured to articulate somewhat independently of one another.

A sole structure can include provisions for maintaining consistent flexibility over different regions of an article. In some embodiments, the depth of two or more sipes may be substantially constant to provide consistent flexibility over different regions of the article. However, in embodiments where the height of a midsole changes over different regions of the article, the depths of two or more sipes may be varied in a manner to provide substantially constant spacing between an upper surface of the midsole and end portions of the sipes. This arrangement may help provide consistent flexibility over different regions of the article. In still other embodiments, the depths of two or more sipes can vary in any other manner to modify the flexibility of a sole structure.

In the current embodiment, midsole 120 has a thickness that varies from forefoot portion 10 to heel portion 14. In particular, midsole 120 has a thickness T1 at forefoot portion 10 and a thickness T2 at heel portion 14. In some cases, thickness T1 may have a value of approximately 3.5 millimeters. Also, in some cases, thickness T2 may have a value of approximately 12.5 millimeters. In addition, midsole 120 has a thickness that varies between T1 and T2 in midfoot portion 12.

In one embodiment, first sipe 161 may have a depth D1. In some cases, the value of depth D1 can vary in the range between 3 and 8 millimeters. In one embodiment, depth D1 may have a value approximately in the range between 5 and 6 millimeters. In addition, second sipe 162, third sipe 163 and fourth sipe 164 may also have depths approximately equal to depth D1. In contrast, fifth sipe 165 may have a depth D2 that is different from depth D1. In some cases, depth D2 may have a value in the range between 5 millimeters and 10 millimeters. In one embodiment, depth D2 may have a value approximately in the range between 7 and 8 millimeters. Still further, sixth sipe 166 may have a depth D3 that is different from depth D1 and depth D2. In some cases, depth D3 may have a value in the range between 6 millimeters and 11 millimeters. In one embodiment, depth D3 may have a value approximately in the range between 8 and 9 millimeters. In addition, seventh sipe 167 and eighth sipe 168 may also have depths approximately equal to depth D3.

In some embodiments, first sipe 161 may include first end portion 241 disposed within midsole 120. In this case, first end portion 241 is spaced apart from upper surface 202 of midsole 120 by spacing S1. In one embodiment, second sipe 162, third sipe 163 and fourth sipe 164 may also be spaced apart from upper surface 202 by a similar amount. In addition, fifth sipe 165 may include first end portion 245 disposed within midsole 120. In this case, first end portion 245 is spaced apart from upper surface 202 of midsole 120 by spacing S2. In the exemplary embodiment, spacing S2 is approximately equal to spacing S1. With this arrangement, the spacing between first sipe 161, second sipe 162, third sipe 163 and fourth sipe 164, fifth sipe 165 and upper surface 202 may be substantially constant throughout forefoot portion 10 and midfoot portion 12. In particular, as the thickness of midsole 120 increases from forefoot portion 10 to midfoot portion 12, the depth of fifth sipe 165 increases to maintain consistent spacing with upper surface 202.

In some embodiments, the depths of sixth sipe 166, seventh sipe 167 and eighth sipe 168 can also be increased to provide consistent spacing between upper surface 202 of midsole 120 and plurality of sipes 160 in heel portion 14. In other embodiments, however, the depths of sixth sipe 166, seventh sipe 167 and eighth sipe 168 can vary in other manners. For example, in this embodiment, sixth sipe 166, seventh sipe 167 and eighth sipe 168 can include end portions 248 that are spaced apart from upper surface 202 by spacing S3. In one embodiment, spacing S3 may be substantially larger than spacing S1 and spacing S2. With this arrangement, heel portion 14 may be provided with a different degree of flexibility since the relative depths of sixth sipe 166, seventh sipe 167 and eighth sipe 168 to midsole 120 are increased in heel portion 14.

A sole structure can include provisions for combining sipes with multiple tread patterns having different nonlinear configurations. In some cases, sipes of different nonlinear configurations can be associated with multiple tread patterns having different nonlinear configurations.

Figure 6:
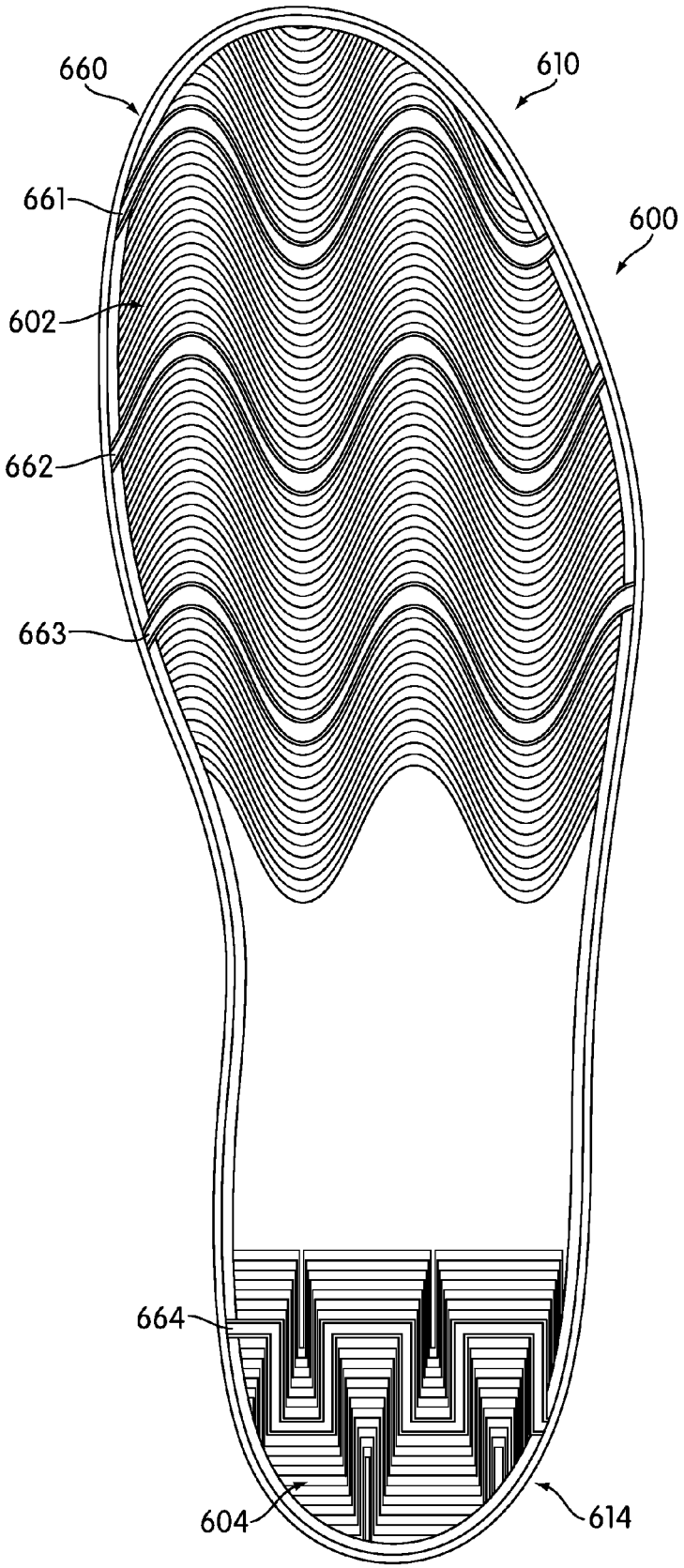
FIG. 6 is a plan view of another embodiment of a sole structure.

FIG. 6 illustrates an embodiment of sole structure 600, including multiple distinct tread patterns. Referring to FIG. 6, first tread pattern 602 is associated with forefoot portion 610 of sole structure 600, while second tread pattern 604 is associated with heel portion 614 of sole structure 600. In this embodiment, first tread pattern 602 and second tread pattern 604 both include tread elements arranged in a nonlinear configuration. Specifically, first tread pattern 602 includes tread elements arranged in a substantially sinusoidal wave configuration. In contrast, second tread pattern 604 includes tread elements arranged in a substantially box wave configuration.

In this embodiment, sole structure 600 is also provided with plurality of sipes 660. Plurality of sipes 660 comprises first sipe 661, second sipe 662, third sipe 663 and fourth sipe 664. Furthermore, first sipe 661, second sipe 662 and third sipe 663 are disposed in forefoot portion 610, while fourth sipe 664 is disposed in heel portion 614.

First sipe 661, second sipe 662 and third sipe 663 may have nonlinear configurations. In particular, first sipe 661, second sipe 662 and third sipe 663 may have substantially similar sinusoidal wave configurations that are similar to the configuration of first tread pattern 602. In addition, fourth sipe 664 may have a nonlinear configuration. Specifically, fourth sipe 664 may have a substantially similar box wave type configuration to the configuration of second tread pattern 604. With this arrangement, the shapes of sipes on a sole structure can be varied to accommodate different nonlinear configurations of two or more tread patterns.

Figure 7:
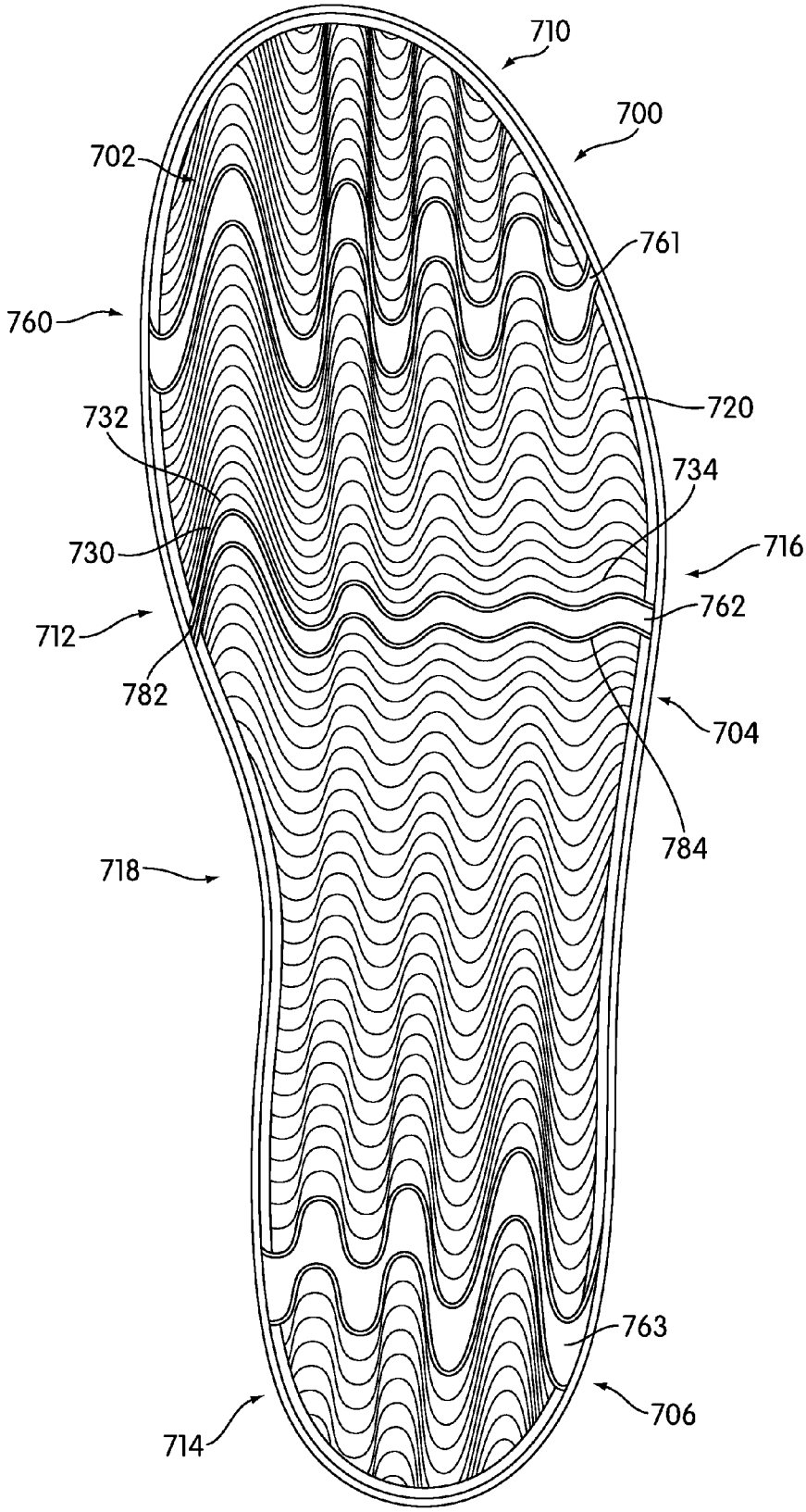
FIG. 7 is a plan view of another embodiment of a sole structure.

FIG. 7 illustrates an embodiment of sole structure 700, including irregular tread patterns. Referring to FIG. 7, sole structure 700 includes first tread pattern 702, second tread pattern 704 and third tread pattern 706 associated with forefoot portion 710, midfoot portion 712 and heel portion 714, respectively. In this embodiment, first tread pattern 702, second tread pattern 704 and third tread pattern 706 comprise tread elements of irregular nonlinear configurations. For example, in forefoot portion 710, first tread pattern 702 comprises tread elements with wave like configurations having amplitudes that increase from lateral side 716 to medial side 718 of outsole 720. In contrast, in heel portion 714, third tread pattern 706 comprises tread elements with wave like configurations having amplitudes that increase from medial side 718 to lateral side 716 of outsole 720.

In addition, in midfoot portion 712, second tread pattern 704 comprises tread elements with a single high amplitude portion adjacent to medial side 718. For example, in this embodiment, second tread pattern 704 includes tread element 730 that includes high amplitude portion 732 and low amplitude portion 734. In a similar manner, other tread elements comprising second tread pattern 704 may have substantially similar irregular configurations.

In this embodiment, sole structure 700 is provided with plurality of sipes 760. Plurality of sipes 760 comprises first sipe 761, second sipe 762 and third sipe 763. In this case, first sipe 761 is disposed in forefoot portion 710. Also, second sipe 762 is disposed in midfoot portion 712. In addition, third sipe 763 is disposed in heel portion 714.

First sipe 761, second sipe 762 and third sipe 763 may have nonlinear configurations to accommodate the nonlinear configurations of first tread pattern 702, second tread pattern 704 and third tread pattern 706. In some cases, first sipe 761 may have an irregular nonlinear configuration that corresponds to the configuration of first tread pattern 702 in forefoot portion 710. In other words, first sipe 761 may have a wave like configuration with an amplitude that increases from lateral side 716 to medial side 718. In addition, second sipe 762 may have an irregular nonlinear configuration that corresponds to the configuration of second tread pattern 704 in midfoot portion 712. In other words, second sipe 762 may have an irregular shape including first sipe portion 782 and second sipe portion 784 that correspond to high amplitude portion 732 and low amplitude portion 734 of tread element 730. Likewise, third sipe 763 may have a nonlinear configuration that corresponds to the configuration of third tread pattern 706 in heel portion 714. In other words, third sipe 763 may have a wave like configuration having an amplitude that increases from medial side 718 to lateral side 716. With this arrangement, the shapes of sipes on a sole structure can be varied to accommodate different nonlinear configurations of two or more tread patterns.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, or plastics. Also, an upper may be made from any suitable material, including, but not limited to: nylon, natural leather, synthetic leather, natural rubber or synthetic rubber.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure including a midsole and an outsole;

the outsole including a tread pattern including a plurality of ridges extending continuously between a medial side of the sole structure and a lateral side of the sole structure, the tread pattern having a first nonlinear configuration;

a sipe disposed on the sole structure and extending continuously between the medial side of the sole structure and the lateral side of the sole structure, the sipe having a second nonlinear configuration; and wherein the second nonlinear configuration of the sipe corresponds to the first nonlinear configuration of the tread pattern.

2. The article of footwear according to claim 1, wherein the sole structure includes a plurality of sipes and wherein each sipe of the plurality of sipes has the second nonlinear configuration.

3. The article of footwear according to claim 2, wherein the plurality of sipes comprises eight sipes.

4. The article of footwear according to claim 1, wherein the first nonlinear configuration is a triangular wave configuration.

5. The article of footwear according to claim 1, wherein the first nonlinear configuration is a herringbone configuration.

6. The article of footwear according to claim 1, wherein the first nonlinear configuration is a square wave configuration.

7. The article of footwear according to claim 1, wherein the first nonlinear configuration is an irregular configuration.

8. The article of footwear according to claim 1, wherein the first nonlinear configuration is an asymmetric configuration.

9. The article of footwear according to claim 1, wherein the sipe includes a midsole sipe portion that is associated with the midsole.

10. The article of footwear according to claim 1, wherein the sipe is located adjacent to the ridges of the tread pattern and the sipe has a shape corresponding to a shape of the ridges.

11. The article of footwear according to claim 1, wherein the plurality of ridges extend continuously between a medial edge of the sole structure and a lateral edge of the sole structure and the sipe extends continuously between the medial edge of the sole structure and the lateral edge of the sole structure.

12. An article of footwear, comprising:

a sole structure including a midsole and an outsole;

the outsole including a tread pattern comprising a tread element, the tread element having a nonlinear configuration;

a sipe disposed adjacent to the tread element;

the tread element comprising a first tread segment oriented in a first direction and a second tread segment oriented in a second direction that is different from the first direction; and wherein the sipe has a first sipe segment that is oriented in the first direction and wherein the sipe has a second sipe segment that is oriented in the second direction;

wherein the sipe includes a midsole sipe portion that is associated with the midsole.

13. The article of footwear according to claim 12, wherein the sole structure includes a plurality of sipes and wherein each sipe of the plurality of sipes has a first sipe segment oriented in the first direction and a second sipe segment oriented in the second direction.

14. The article of footwear according to claim 12, wherein the sipe includes an outsole sipe portion that is associated with the outsole.

15. The article of footwear according to claim 12, wherein the sipe divides the outsole into a first outsole portion and a second outsole portion.

16. The article of footwear according to claim 12, wherein the sole structure includes a first sipe in a forefoot portion of the sole structure and a second sipe in a midfoot portion of the sole structure.

17. The article of footwear according to claim 16, wherein the height of the midsole varies between the forefoot portion and the midfoot portion and wherein the first sipe and the second sipe are spaced apart from an upper surface of the midsole by a substantially similar amount.

18. An article of footwear, comprising:

a sole structure including a midsole and an outsole;

the outsole including a first tread pattern associated with a forefoot portion of the outsole, the first tread pattern having a first nonlinear configuration;

the outsole including a second tread pattern associated with a midfoot portion of the outsole, the second tread pattern having a second nonlinear configuration that is different than the first nonlinear configuration;

a first sipe disposed in the forefoot portion of the outsole and a second sipe disposed in the midfoot portion of the outsole; and wherein the first sipe has the first nonlinear configuration and wherein the second sipe has the second nonlinear configuration;

wherein a height of the midsole varies between the forefoot portion and the midfoot portion and wherein the first sipe and the second sipe are spaced apart from an upper surface of the midsole by a substantially similar amount.

19. The article of footwear according to claim 18, wherein at least one of the first sipe and the second sipe includes a midsole sipe portion that is associated with the midsole.

20. The article of footwear according to claim 18, wherein outsole includes a third tread pattern associated with a third portion of the outsole, the third tread pattern having a third nonlinear configuration that is different from the first nonlinear configuration and the second nonlinear configuration.

21. The article of footwear according to claim 20, wherein the sole structure includes a third sipe disposed in the third portion and wherein the third sipe has the third nonlinear configuration.

22. The article of footwear according to claim 21, wherein the third portion is an arch portion of the outsole.

23. The article of footwear according to claim 18, wherein the forefoot portion includes two or more sipes and wherein the two or more sipes have the first nonlinear configuration.

* * * * *